US005121842A

United States Patent [19]

Osborne

[11] Patent Number: 5,121,842

[45] Date of Patent: Jun. 16, 1992

[54] CAP TREE APPARATUS

[76] Inventor: Malcolm Osborne, R.D. 2, Box 493, Everett, Pa. 15537

[21] Appl. No.: 729,192

[22] Filed: Jul. 12, 1991

[51] Int. Cl.[5] ..... A47F 7/06; A47G 25/10

[52] U.S. Cl. ..... 211/33; 211/30

[58] Field of Search ..... 211/32, 33, 71, 89, 211/4, 8, 30

[56] References Cited

U.S. PATENT DOCUMENTS

| | | | |
|---|---|---|---|
| 1,407,720 | 2/1922 | Boyett | 211/32 X |
| 1,747,951 | 2/1930 | Reichert | 211/33 X |
| 1,904,725 | 4/1933 | Gerhold | 211/41 |
| 2,010,093 | 8/1935 | Lazarus | 211/33 X |
| 2,707,564 | 5/1955 | Smith | 211/32 |
| 2,937,758 | 5/1960 | Tabb | 211/89 X |
| 3,967,346 | 7/1976 | Young, Jr. | 211/89 |
| 4,461,387 | 7/1984 | Belokin, Jr. | 211/71 |
| 5,038,941 | 8/1991 | Bastiaansen | 211/89 X |

FOREIGN PATENT DOCUMENTS

| | | | |
|---|---|---|---|
| 34978 | 6/1929 | France | 211/89 |
| 1555703 | 12/1968 | France | 211/89 |

*Primary Examiner*—Friedman Carl D.
*Assistant Examiner*—Derek J. Berger
*Attorney, Agent, or Firm*—Hugh E. Smith

[57] ABSTRACT

A vertical post mounted to a base in an orthogonal relationship includes plural columns of clip members, with each clip member arranged to mount a cap thereto for display and organization of a plurality of such cap members. A modification of the invention includes flexible alignment rods wound about a spool within the post adjacent each clip projecting through an opening in the post aligned with an upper terminal end of each clip to provide underlying support for a cap member assocated with each clip. The alignment rods are retractably contained within the post when not in use.

4 Claims, 4 Drawing Sheets

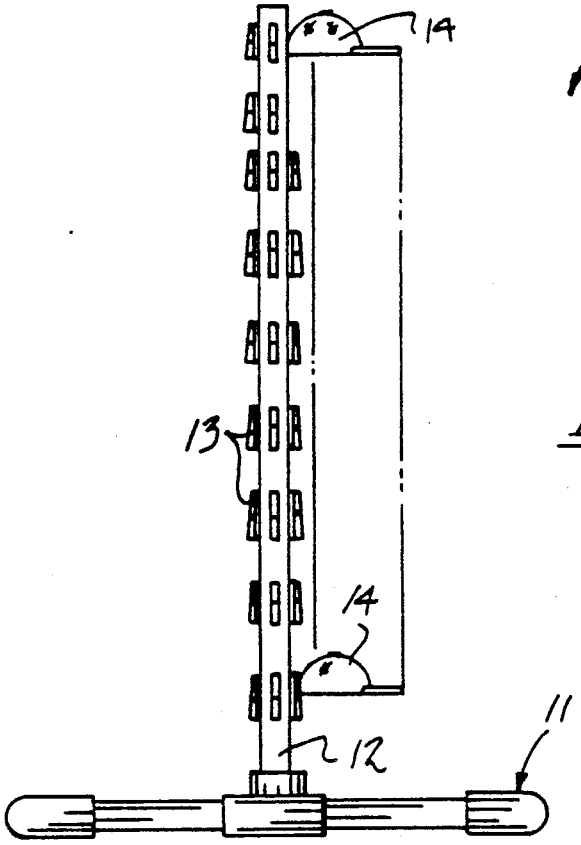
Fig 1
Fig 2
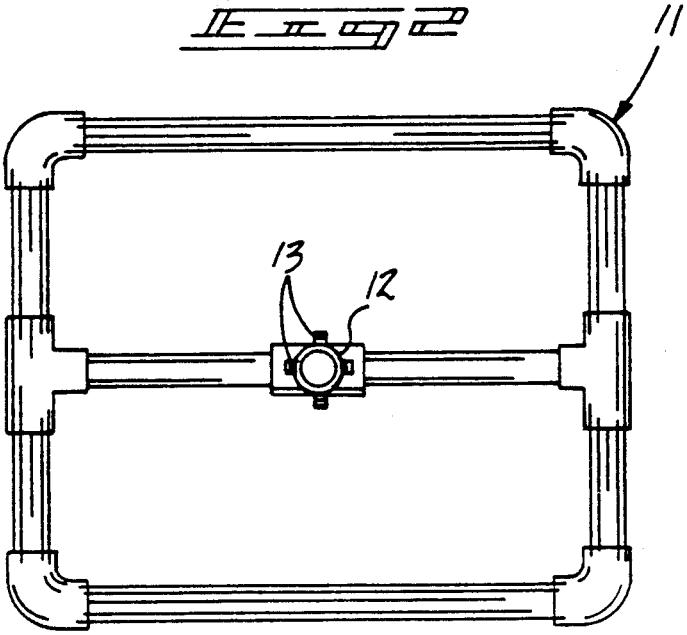

CAP TREE APPARATUS

BACKGROUND OF THE INVENTION

1. Field of the Invention

The field of invention relates to support apparatus, and more particularly pertains to a new and improved cap tree apparatus wherein the same is arranged for the organized arrangement and alignment of caps for display and storage of the caps.

2. Description of the Prior Art

Collecting of caps and their display associating caps with respective sporting teams is a hobby available to many individuals, wherein the proper mounting and display of such caps is frequently of a cumbersome and inefficient procedure.

The instant invention attempts to overcome deficiencies of the prior art by providing a post structure arranged to mount the caps in a convenient and organized manner for their display and storage. Prior art structure for supporting hats and the like has been addressed in the prior art and exemplified in U.S. Pat. No. 2,010,093 to Lazarus wherein a central post includes rigid pegs projecting upwardly relative to the post for support of caps thereon.

U.S. Pat. No. 1,747,951 to Reichert sets forth a hat display rack utilizing a plurality of brackets extending in an orthogonal relationship relative to a primary post for supporting of caps thereon.

U.S. Pat. No. 2,709,004 to Dahlstrom sets forth a base mounting a plurality of leg extending upwardly thereof for supporting of hats at upper terminal ends of each leg.

U.S. Pat. No. 2,198,037 to Jarnagin sets forth a hat box mounting a plurality of loops therewithin for supporting a hat upon each loop.

U.S. Pat. No. 3,204,333 to Wise sets forth a clothes tree wherein a plurality of hooks are mounted to a central post.

As such, it may be appreciated that there continues to be a need for a new and improved cap tree apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of cap support apparatus now present in the prior art, the present invention provides a cap tree apparatus wherein the same includes a primary post mounting a plurality of columns of support clips thereon. As such, the general purpose of the present invention, which will be described subsequently in greater detail, is to provide a new and improved cap tree apparatus which has all the advantages of the prior art cap support apparatus and none of the disadvantages.

To attain this, the present invention provides a vertical post mounted to a base in an orthogonal relationship including plural columns of clip members, with each clip member arranged to mount a cap thereto for display and organization of a plurality of such cap members. A modification of the invention includes flexible alignment rods wound about a spool within the post adjacent each clip projecting through an opening in the post aligned with an upper terminal end of each clip to provide underlying support for a cap member associated with each clip. The alignment rods are retractably contained within the post when not in use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cap tree apparatus which has all the advantages of the prior art cap support apparatus and none of the disadvantages.

It is another object of the present invention to provide a new and improved cap tree apparatus which may be easily and efficiently manufactured and marketed.

It is a further object of the present invention to provide a new and improved cap tree apparatus which is of a durable and reliable construction.

An even further object of the present invention is to provide a new and improved cap tree apparatus which is susceptible of a low cost of manufacture with regard to both materials and labor, and which accordingly is then susceptible of low prices of sale to the consuming public, thereby making such cap tree apparatus economically available to the buying public.

Still yet another object of the present invention is to provide a new and improved cap tree apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic side view of the instant invention.

FIG. 2 is an orthographic top view of the instant invention.

DESCRIPTION OF THE PREFERRED EMBODIMENT

Figure 3:
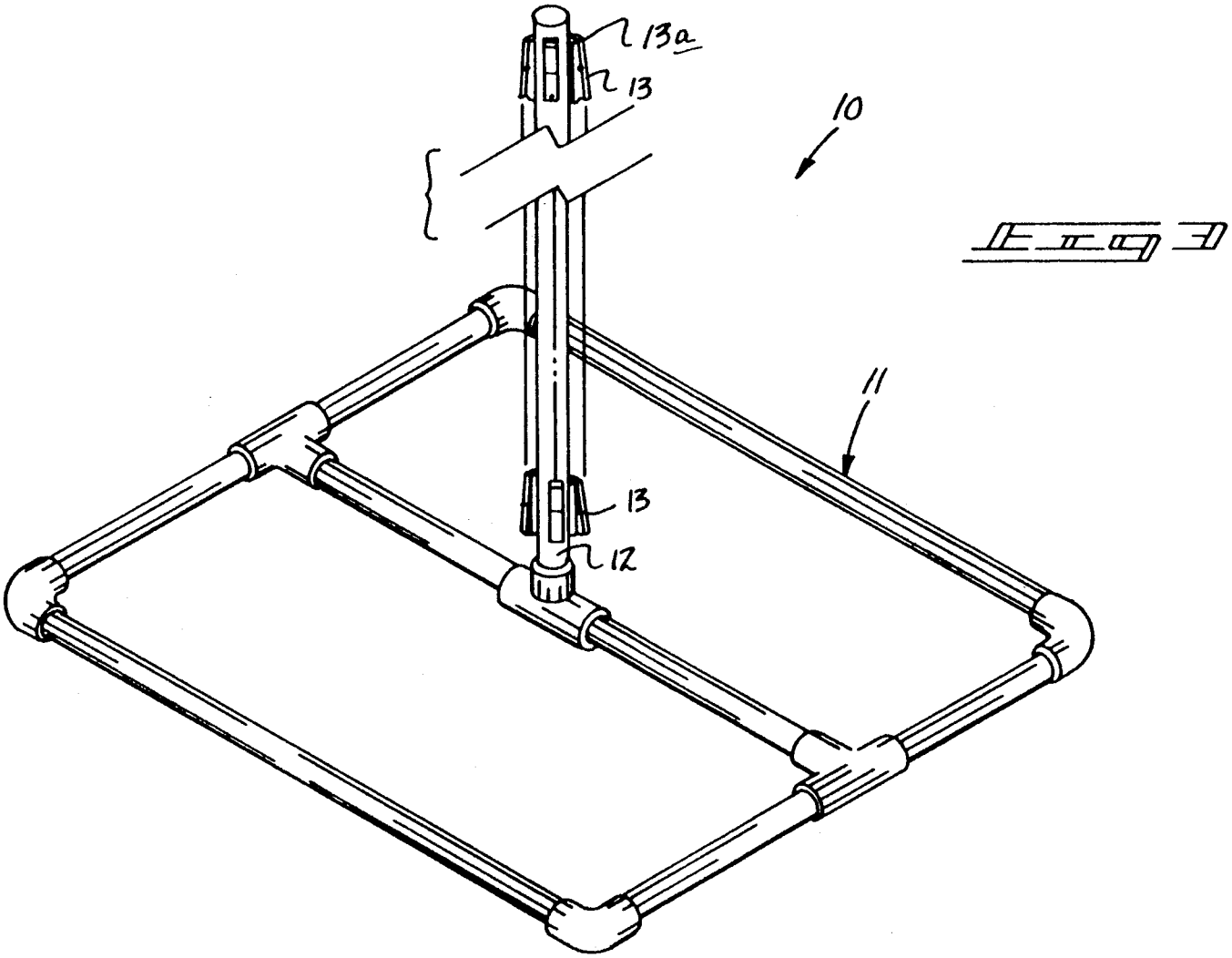
FIG. 3 is an isometric illustration of the instant invention.

With reference now to the drawings, and in particular to FIGS. 1 to 6 thereof, a new and improved cap tree apparatus embodying the principles and concepts of the present invention and generally designated by the reference numerals 10 and 10*a* will be described.

More specifically, the cap tree apparatus 10 of the instant invention essentially comprises a support base 11, with the support base 11 arranged for positioning upon an underlying surface, with a central vertical tubular post 12 fixedly and orthogonally mounted medially of the support base 11 projecting upwardly thereof, wherein the tubular post is coaxially aligned and includes plural parallel columns of mounting clips 13. The mounting clips 13 each include a plurality of cooperating spring biased clamping jaws 13*a* cooperative and biased relative to one another through a spring member 17 (see FIG. 5 for example). The clips 13 in each respective column are in a linearly aligned relationship for supporting and clipping a cap member 14 between the jaws 13*a*. In this manner, plural columns of the caps are provided for display and storage.

Figure 4:
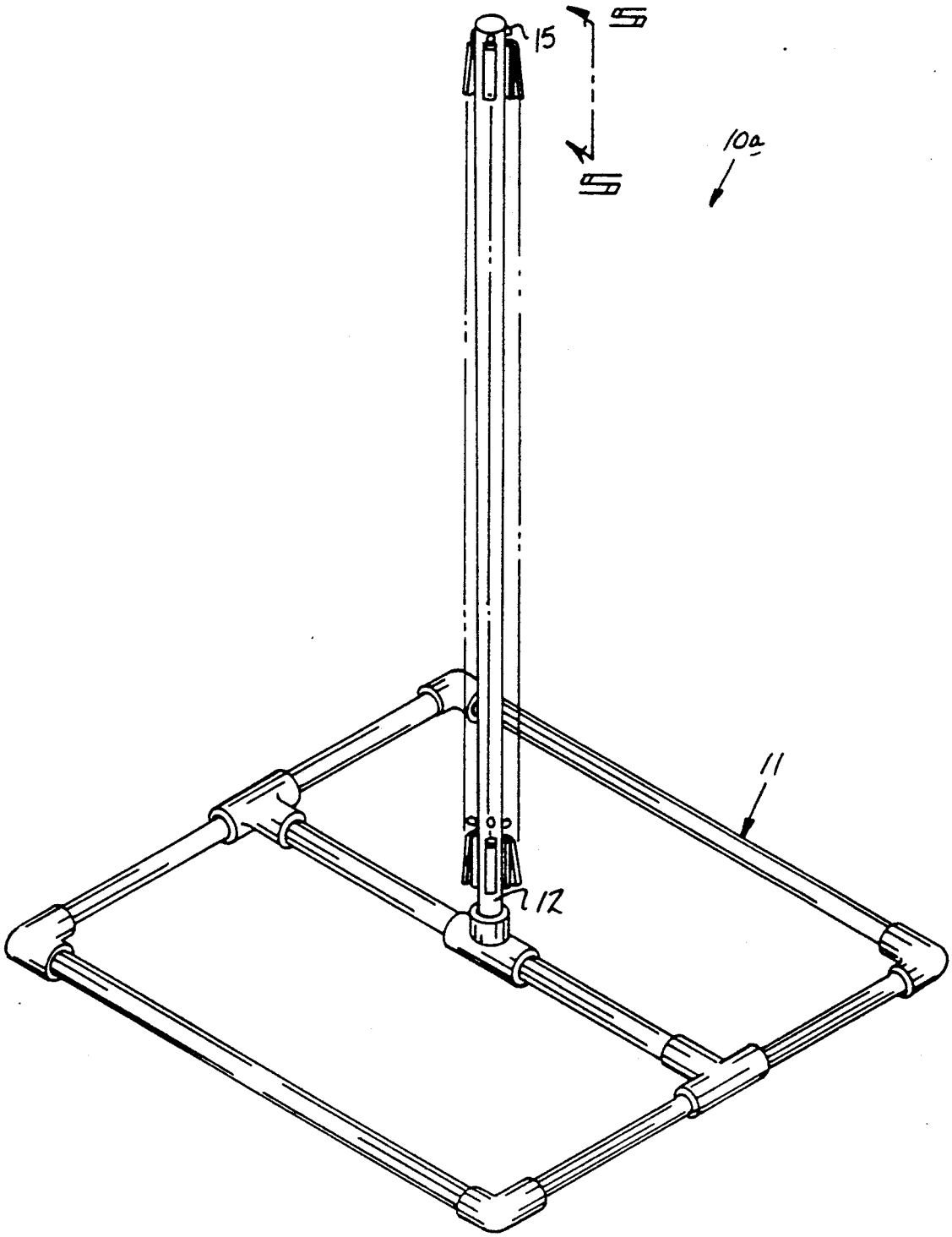
FIG. 4 is an isometric illustration of a modified aspect of the invention.
Figure 5:
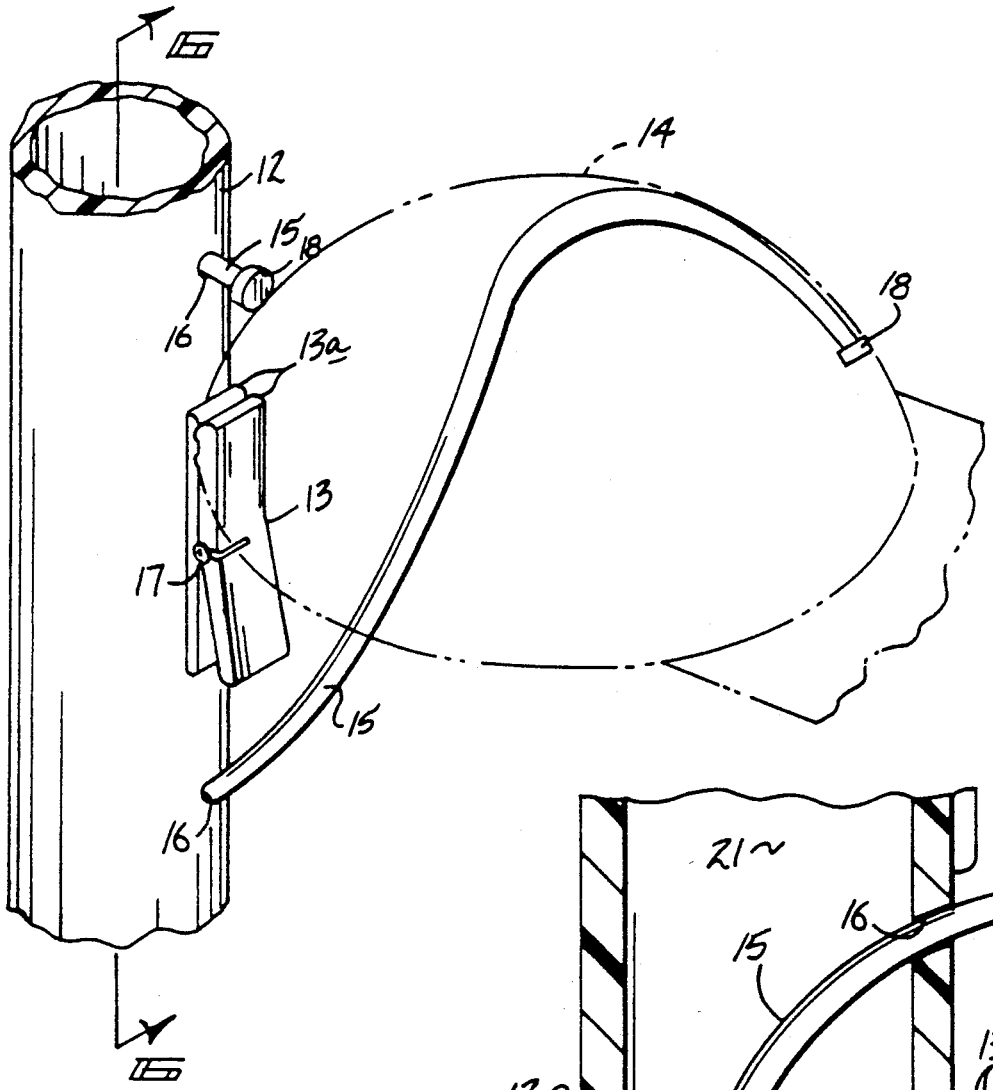
FIG. 5 is an orthographic view, taken along the lines 5—5 of FIG. 4 in the direction indicated by the arrows.
Figure 6:
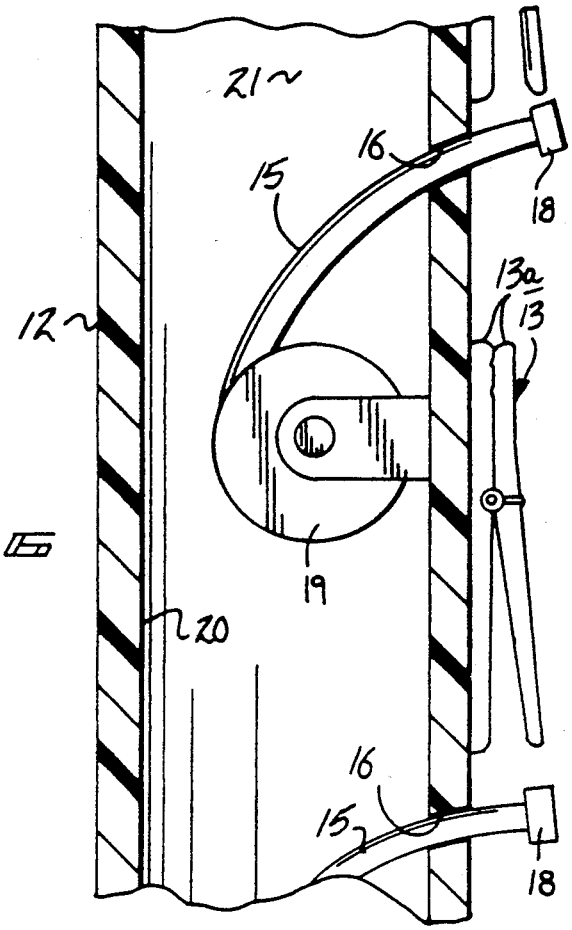
FIG. 6 is an orthographic view, taken along the lines 6—6 of FIG. 5 in the direction indicated by the arrows.

FIGS. 4–6 illustrate a modified apparatus 10*a*, wherein the tubular post 12 includes a plurality of directing bores 16 defined by a first diameter, wherein each directing bore is oriented in a non-orthogonal or oblique relationship through the wall of the post 12. A bore 16 is oriented relative to and adjacent each clip 13 adjacent to and spaced from the jaws 13*a*. A flexible resilient alignment rod 15 is retractably and extensibly directed through each associated bore 16 and is formed of a memory retentent material. The rods 15, when directed through the associated bores 16, of each associated clip 13, projects upwardly thereof to provide underlying support for associated cap member 14, as illustrated in FIG. 5. A forward terminal end of each rod 15 positioned exteriorly of the post 12 includes a protecting cap 18 defined by a second diameter greater than the first diameter to deny a complete retraction of the rod 15 within the post 12 through the bore 16 and further afford protection to the cap 14 when the rod 15 is directed into the cap, as illustrated in FIG. 5. Each of the alignment rods 15 are wound about a support spool 19, and each support spool of each associated alignment rod 15 is mounted fixedly to the vertical post's interior surface 20 below and adjacent a respective bore 16. It should be further noted that the central axis 21 of the tubular post 12 is oriented to provide symmetry for the tubular post, as well as the support clips and associated spool structure mounted within the tubular post.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the Unites States is as follows:

1. A cap tree apparatus, comprising in combination, a support base, the support base including a central tubular post orthogonally and fixedly mounted to the support base extending upwardly thereof, with the post including a plurality of parallel columns of mounting clips mounted to an exterior surface of the tubular post, and each mounting clip includes a plurality of spring biased jaws biased together to secure a cap member between the jaws, and the tubular post includes plural columns of directing bores directed through the tubular post, with each of said directing bores positioned adjacent to and above an upper terminal end of each pair of spring biased jaws, and a plurality of alignment rods, and at least one alignment rod of the plurality of alignment rods directed through each directing bore, and each alignment rod formed of a flexible resilient memory retentent material, and each alignment rod is oriented for reception within a cap member when the cap member is secured to an associated mounting clip of the plurality of mounting clips.

2. An apparatus as set forth in claim 1 wherein each directing bore is directed through the tubular post defining an oblique angle relative to a central axis of the tubular post.

3. An apparatus as set forth in claim 2 wherein each free terminal end of each alignment rod projecting exteriorly of the tubular post includes a protecting cap mounted thereon, the protecting cap is formed of a second diameter, and each directing bore is formed of a first diameter, wherein the protecting cap prevents complete retraction of the alignment rod within the tubular post.

4. An apparatus as set forth in claim 3 wherein each alignment rod of the plurality of alignment rods includes a support spool, each support spool fixedly mounted to an interior surface of the tubular post, and each support spool positioned adjacent a clip member.

* * * * *